US008727169B2

(12) United States Patent
Nguyen

(10) Patent No.: US 8,727,169 B2
(45) Date of Patent: May 20, 2014

(54) METALLIC BEVERAGE CAN END CLOSURE WITH OFFSET COUNTERSINK

(75) Inventor: Tuan A. Nguyen, Golden, CO (US)

(73) Assignee: Ball Corporation, Broomfield, CO (US)

( * ) Notice: Subject to any disclaimer, the term of this patent is extended or adjusted under 35 U.S.C. 154(b) by 277 days.

(21) Appl. No.: 12/949,243

(22) Filed: Nov. 18, 2010

(65) Prior Publication Data

US 2012/0125935 A1 May 24, 2012

(51) Int. Cl.
*B65D 45/00* (2006.01)

(52) U.S. Cl.
USPC ..... 220/315

(58) Field of Classification Search
USPC ..... 220/623, 619; 413/56, 62
See application file for complete search history.

(56) References Cited

U.S. PATENT DOCUMENTS

| | | | | |
|---|---|---|---|---|
| 91,754 | A | 6/1869 | Lawrence | |
| 163,747 | A | 5/1875 | Cummings | |
| 706,296 | A | 8/1902 | Bradley | |
| 766,604 | A | 8/1904 | Dilg | |
| 801,683 | A | 10/1905 | Penfold | |
| 818,438 | A * | 4/1906 | Heindorf | 220/618 |
| 868,916 | A | 10/1907 | Dieckmann | |
| 1,045,055 | A | 11/1912 | Mittinger, Jr. | |
| 2,017,460 | A | 10/1935 | Hothersall | |
| 2,060,145 | A | 11/1936 | Vogel | |
| 2,119,533 | A | 6/1938 | Fink | |
| 2,318,603 | A | 5/1943 | Erb | |
| D141,415 | S | 5/1945 | Wargel et al. | |
| 2,759,628 | A | 8/1956 | Sokoloff | |
| 2,894,844 | A | 7/1959 | Shakman | |
| 3,023,927 | A | 3/1962 | Ehman | |
| 3,025,814 | A | 3/1962 | Currie et al. | |
| 3,105,765 | A | 10/1963 | Creegan | |
| 3,176,872 | A | 4/1965 | Zundel | |
| 3,208,627 | A | 9/1965 | Lipske | |
| 3,251,515 | A | 5/1966 | Henchert et al. | |
| 3,268,105 | A | 8/1966 | Geiger | |
| D206,500 | S | 12/1966 | Nissen et al. | |
| 3,383,748 | A | 5/1968 | Galimberti et al. | |
| 3,397,811 | A | 8/1968 | Lipske | |
| 3,417,898 | A | 12/1968 | Bozek et al. | |
| 3,480,175 | A | 11/1969 | Khoury | |
| 3,525,455 | A | 8/1970 | Saunders | |
| 3,564,895 | A | 2/1971 | Pfanner et al. | |

(Continued)

FOREIGN PATENT DOCUMENTS

| | | |
|---|---|---|
| CH | 327383 | 1/1958 |
| DE | 734942 | 5/1943 |

(Continued)

OTHER PUBLICATIONS

International Search Report for International Patent Application No. PCT/US2011/061113, mailed Mar. 16, 2012 4 pages.

(Continued)

*Primary Examiner* — Steven A. Reynolds
*Assistant Examiner* — King M Chu
(74) *Attorney, Agent, or Firm* — Sheridan Ross P.C.

(57) ABSTRACT

The present invention describes a beverage container end closure that utilizes less material and has improved internal buckle strength based on the geometric configuration of a chuck wall, inner panel wall, outer panel wall, and central panel and that utilizes an outwardly oriented countersink.

19 Claims, 9 Drawing Sheets

(56) References Cited

U.S. PATENT DOCUMENTS 3,630,408 A 12/1971 Elser et al.
3,650,387 A 3/1972 Hornsby et al.
3,715,054 A 2/1973 Gedde
3,734,338 A 5/1973 Schubert
3,744,667 A 7/1973 Fraze et al.
3,745,623 A 7/1973 Wentorf, Jr. et al.
3,757,716 A 9/1973 Gedde
3,762,005 A 10/1973 Erkfritz
3,765,352 A 10/1973 Schubert et al.
D229,396 S 11/1973 Zundel
3,774,801 A 11/1973 Gedde
3,814,279 A 6/1974 Rayzal
3,836,038 A 9/1974 Cudzik
3,843,014 A 10/1974 Cospen et al.
3,868,919 A 3/1975 Schrecker et al.
3,871,314 A 3/1975 Stargell
3,874,553 A 4/1975 Schultz et al.
3,891,117 A 6/1975 Dragomier et al.
3,904,069 A 9/1975 Toukmanian
3,967,752 A 7/1976 Cudzik
3,982,657 A 9/1976 Keller et al.
3,983,827 A 10/1976 Meadors
4,015,744 A 4/1977 Brown
4,024,981 A 5/1977 Brown
4,030,631 A 6/1977 Brown
4,031,837 A 6/1977 Jordan
4,037,550 A 7/1977 Zofko
4,043,168 A 8/1977 Mazurek
4,056,871 A 11/1977 Bator
4,077,538 A 3/1978 Waterbury
4,087,193 A 5/1978 Mundy
4,093,102 A 6/1978 Kraska
4,109,599 A 8/1978 Schultz
4,116,361 A 9/1978 Stargell
4,126,652 A 11/1978 Oohara et al.
4,127,212 A 11/1978 Waterbury
4,148,410 A 4/1979 Brown
4,150,765 A 4/1979 Mazurek
4,210,257 A 7/1980 Radtke
4,213,324 A 7/1980 Kelley et al.
4,215,795 A 8/1980 Elser
4,217,843 A 8/1980 Kraska
4,271,778 A 6/1981 La Bret
4,274,351 A 6/1981 Boardman
4,276,993 A 7/1981 Hassegaun
4,286,728 A 9/1981 Fraze et al.
4,341,321 A 7/1982 Gombas
4,365,499 A 12/1982 Hirota et al.
4,387,827 A 6/1983 Ruemer, Jr.
4,402,419 A 9/1983 MacPherson
4,420,283 A 12/1983 Post
4,434,641 A 3/1984 Nguyen
4,435,969 A 3/1984 Nichols et al.
4,448,322 A 5/1984 Kraska
4,467,933 A 8/1984 Wilkinson et al.
4,516,420 A 5/1985 Bulso et al.
D279,265 S 6/1985 Turner et al.
4,530,631 A 7/1985 Kaminski et al.
D281,581 S 12/1985 MacEwen
4,559,801 A 12/1985 Smith et al.
4,563,887 A 1/1986 Bressan et al.
4,571,978 A 2/1986 Taube et al.
4,577,774 A 3/1986 Nguyen
4,578,007 A 3/1986 Diekhoff
4,587,825 A 5/1986 Bulso et al.
4,587,826 A 5/1986 Bulso et al.
4,606,472 A 8/1986 Taube et al.
D285,661 S 9/1986 Brown Bill
4,641,761 A 2/1987 Smith et al.
4,674,649 A 6/1987 Pavely
4,681,238 A 7/1987 Sanchez
4,685,582 A 8/1987 Pulciani et al.
4,685,849 A 8/1987 Labarge et al.
4,697,972 A 10/1987 Le Bret et al.
4,704,887 A 11/1987 Bachmann et al.
4,713,958 A 12/1987 Bulso, Jr. et al.
4,715,208 A 12/1987 Bulso, Jr. et al.
4,716,755 A 1/1988 Bulso, Jr. et al.
4,722,215 A 2/1988 Taube et al.
4,735,863 A 4/1988 Bachmann et al.
4,781,047 A 11/1988 Bressan et al.
4,790,705 A 12/1988 Wilkinson et al.
4,796,772 A 1/1989 Nguyen
4,804,106 A 2/1989 Saunders
4,808,052 A 2/1989 Bulso, Jr. et al.
4,809,861 A 3/1989 Wilkinson
D300,607 S 4/1989 Ball
D300,608 S 4/1989 Taylor et al.
4,820,100 A 4/1989 Riviere
4,823,973 A 4/1989 Jewitt et al.
4,832,223 A 5/1989 Kalenak et al.
4,832,236 A 5/1989 Greaves
4,865,506 A 9/1989 Kaminski
D304,302 S 10/1989 Dalli et al.
4,885,924 A 12/1989 Claydon et al.
4,890,759 A 1/1990 Scanga et al.
4,893,725 A 1/1990 Ball et al.
4,895,012 A 1/1990 Cook et al.
4,919,294 A 4/1990 Kawamoto
RE33,217 E 5/1990 Nguyen
4,930,658 A 6/1990 McEldowney
4,934,168 A 6/1990 Osmanski et al.
4,955,223 A 9/1990 Stodd et al.
4,967,538 A 11/1990 Leftault, Jr. et al.
4,991,735 A 2/1991 Biondich
4,994,009 A 2/1991 McEldowney
4,995,223 A 2/1991 Spatafora et al.
5,016,463 A 5/1991 Johansson et al.
5,026,960 A 6/1991 Slutz et al.
5,027,580 A 7/1991 Hymes et al.
5,042,284 A 8/1991 Stodd et al.
5,046,637 A 9/1991 Kysh
5,064,087 A 11/1991 Koch
5,066,184 A 11/1991 Taura et al.
5,069,355 A 12/1991 Matuszak
5,105,977 A 4/1992 Taniuchi
5,129,541 A 7/1992 Voigt et al.
5,141,367 A 8/1992 Beeghly et al.
5,143,504 A 9/1992 Braakman
5,145,086 A 9/1992 Krause
5,149,238 A 9/1992 McEldowney et al.
5,174,706 A 12/1992 Taniuchi
5,222,385 A 6/1993 Halasz et al.
D337,521 S 7/1993 McNulty
5,245,848 A 9/1993 Lee, Jr. et al.
5,289,938 A 3/1994 Sanchez
D347,172 S 5/1994 Heynan et al.
5,309,749 A 5/1994 Stodd
5,320,469 A 6/1994 Katou et al.
5,325,696 A 7/1994 Jentzsch et al.
5,346,087 A 9/1994 Klein
5,355,709 A 10/1994 Bauder et al.
5,356,256 A 10/1994 Turner et al.
D352,898 S 11/1994 Vacher
5,381,683 A 1/1995 Cowling
D356,498 S 3/1995 Strawser
5,465,599 A 11/1995 Lee, Jr.
5,494,184 A 2/1996 Noguchi et al.
5,497,184 A 3/1996 Noguchi et al.
5,502,995 A 4/1996 Stodd
5,524,468 A 6/1996 Jentzsch et al.
5,527,143 A 6/1996 Turner et al.
5,540,352 A 7/1996 Halasz et al.
5,555,992 A 9/1996 Sedgeley
5,563,107 A 10/1996 Dubensky et al.
5,582,319 A 12/1996 Heyes et al.
5,590,807 A 1/1997 Forrest et al.
5,598,734 A 2/1997 Forrest et al.
5,612,264 A 3/1997 Nilsson et al.
5,634,366 A 6/1997 Stodd
5,636,761 A * 6/1997 Diamond et al. ..... 220/619
5,653,355 A 8/1997 Tominaga et al.
5,676,512 A 10/1997 Diamond et al.
5,685,189 A 11/1997 Nguyen et al.

(56) References Cited

U.S. PATENT DOCUMENTS

| | | | | |
|---|---|---|---|---|
| 5,697,242 | A | 12/1997 | Halasz et al. | |
| 5,706,686 | A | 1/1998 | Babbitt et al. | |
| 5,749,488 | A | 5/1998 | Bagwell et al. | |
| 5,823,730 | A | 10/1998 | La Rovere | |
| 5,829,623 | A | 11/1998 | Otsuka et al. | |
| 5,857,374 | A | 1/1999 | Stodd | |
| D406,236 | S | 3/1999 | Brifcani et al. | |
| 5,911,551 | A | 6/1999 | Moran | |
| 5,934,127 | A | 8/1999 | Ihly | |
| 5,950,858 | A | 9/1999 | Sergeant | |
| 5,957,647 | A | 9/1999 | Hinton | |
| 5,969,605 | A | 10/1999 | McIntyre et al. | |
| 5,971,259 | A | 10/1999 | Bacon | |
| 6,024,239 | A | 2/2000 | Turner et al. | |
| 6,033,789 | A | 3/2000 | Saveker et al. | |
| 6,055,836 | A | 5/2000 | Waterworth et al. | |
| 6,058,753 | A | 5/2000 | Jowitt et al. | |
| 6,065,634 | A | 5/2000 | Brifcani et al. | |
| 6,089,072 | A | 7/2000 | Fields | |
| 6,102,243 | A | 8/2000 | Fields et al. | |
| 6,126,034 | A | 10/2000 | Borden et al. | |
| 6,131,761 | A | 10/2000 | Cheng et al. | |
| 6,158,608 | A | 12/2000 | Schlattl | |
| 6,234,337 | B1 | 5/2001 | Huber et al. | |
| 6,290,447 | B1 | 9/2001 | Siemonsen et al. | |
| 6,296,139 | B1 | 10/2001 | Hanafusa et al. | |
| D452,155 | S | 12/2001 | Stodd | |
| 6,386,013 | B1 | 5/2002 | Werth | |
| 6,408,498 | B1 | 6/2002 | Fields et al. | |
| 6,419,110 | B1 | 7/2002 | Stodd | |
| 6,425,493 | B1 | 7/2002 | Gardiner | |
| 6,425,721 | B1 | 7/2002 | Zysset | |
| 6,428,261 | B1 | 8/2002 | Zysset | |
| 6,460,723 | B2 | 10/2002 | Nguyen et al. | |
| 6,499,622 | B1 | 12/2002 | Neiner | |
| 6,516,968 | B2 | 2/2003 | Stodd | |
| 6,526,799 | B2 | 3/2003 | Ferraro et al. | |
| 6,561,004 | B1 | 5/2003 | Neiner et al. | |
| 6,616,393 | B1 | 9/2003 | Jentzsch | |
| D480,304 | S | 10/2003 | Stodd | |
| 6,634,837 | B1 | 10/2003 | Anderson | |
| 6,658,911 | B2 | 12/2003 | McClung | |
| 6,702,142 | B2 | 3/2004 | Neiner | |
| 6,702,538 | B1 | 3/2004 | Heinicke et al. | |
| 6,736,283 | B1 | 5/2004 | Santamaria et al. | |
| 6,748,789 | B2 | 6/2004 | Turner et al. | |
| 6,761,280 | B2 | 7/2004 | Zonker et al. | |
| 6,772,900 | B2 | 8/2004 | Turner et al. | |
| 6,837,089 | B2 | 1/2005 | Jentzsch et al. | |
| 6,848,875 | B2 | 2/2005 | Brifcani et al. | |
| 6,877,941 | B2 | 4/2005 | Brifcani et al. | |
| 6,915,553 | B2 | 7/2005 | Turner et al. | |
| 6,935,826 | B2 | 8/2005 | Brifcani et al. | |
| 6,959,577 | B2 | 11/2005 | Jentzsch | |
| 6,968,724 | B2 | 11/2005 | Hubball | |
| 7,004,345 | B2 | 2/2006 | Turner et al. | |
| 7,100,789 | B2 | 9/2006 | Nguyen et al. | |
| 7,125,214 | B2 | 10/2006 | Carrein et al. | |
| 7,174,762 | B2 | 2/2007 | Turner et al. | |
| 7,263,868 | B2 | 9/2007 | Jentzsch et al. | |
| 7,341,163 | B2 | 3/2008 | Stodd | |
| 7,350,392 | B2 | 4/2008 | Turner et al. | |
| 7,370,774 | B2 * | 5/2008 | Watson et al. | 220/619 |
| 7,380,684 | B2 | 6/2008 | Reed et al. | |
| 7,500,376 | B2 | 3/2009 | Bathurst et al. | |
| 7,506,779 | B2 * | 3/2009 | Jentzsch et al. | 220/619 |
| 7,591,392 | B2 | 9/2009 | Watson et al. | |
| 7,819,275 | B2 | 10/2010 | Stodd | |
| 7,874,450 | B2 * | 1/2011 | Shibasaka et al. | 220/619 |
| 8,205,477 | B2 * | 6/2012 | Jentzsch et al. | 72/379.4 |
| 2001/0037668 | A1 | 11/2001 | Fields | |
| 2002/0139805 | A1 | 10/2002 | Chasteen et al. | |
| 2002/0158071 | A1 * | 10/2002 | Chasteen et al. | 220/269 |
| 2003/0121924 | A1 | 7/2003 | Stodd | |
| 2003/0173367 | A1 * | 9/2003 | Nguyen et al. | 220/669 |
| 2003/0177803 | A1 | 9/2003 | Golding et al. | |
| 2003/0198538 | A1 | 10/2003 | Brifcani et al. | |
| 2004/0026433 | A1 | 2/2004 | Brifcani et al. | |
| 2004/0026434 | A1 | 2/2004 | Brifcani et al. | |
| 2004/0052593 | A1 | 3/2004 | Anderson | |
| 2004/0140312 | A1 | 7/2004 | Neiner | |
| 2004/0211786 | A1 | 10/2004 | Turner et al. | |
| 2004/0238546 | A1 | 12/2004 | Watson et al. | |
| 2005/0247717 | A1 | 11/2005 | Brifcani et al. | |
| 2005/0252922 | A1 | 11/2005 | Reed et al. | |
| 2006/0010957 | A1 | 1/2006 | Hubball | |
| 2006/0071005 | A1 | 4/2006 | Bulso | |
| 2009/0020543 | A1 | 1/2009 | Bulso | |
| 2010/0006571 | A1 * | 1/2010 | Shibasaka et al. | 220/200 |
| 2010/0243663 | A1 * | 9/2010 | Jentzsch et al. | 220/619 |

FOREIGN PATENT DOCUMENTS

| | | |
|---|---|---|
| DE | 9211788 | 1/1993 |
| EP | 0049020 | 4/1982 |
| EP | 0139282 | 5/1985 |
| EP | 0153115 | 8/1985 |
| EP | 0340955 | 11/1989 |
| EP | 0348070 | 12/1989 |
| EP | 0482581 | 4/1992 |
| EP | 0828663 | 12/1999 |
| EP | 1361164 | 11/2003 |
| FR | 917771 | 1/1947 |
| GB | 767029 | 1/1957 |
| GB | 2196891 | 5/1988 |
| GB | 2218024 | 11/1989 |
| GB | 2315478 | 2/1998 |
| JP | 49-096887 | 9/1974 |
| JP | 50-144580 | 11/1975 |
| JP | 54-074184 | 6/1979 |
| JP | 55-122945 | 9/1980 |
| JP | 56-032227 | 4/1981 |
| JP | 56-53835 | 5/1981 |
| JP | 56-53836 | 5/1981 |
| JP | 56-107323 | 8/1981 |
| JP | 57-44435 | 3/1982 |
| JP | 57-94436 | 6/1982 |
| JP | 57-117323 | 7/1982 |
| JP | 58-035028 | 3/1983 |
| JP | 58-35029 | 3/1983 |
| JP | 59-144535 | 8/1984 |
| JP | 61-023533 | 2/1986 |
| JP | 63-125152 | 5/1988 |
| JP | 01-167050 | 6/1989 |
| JP | 01-170538 | 7/1989 |
| JP | 01-289526 | 11/1989 |
| JP | H02-11033 | 1/1990 |
| JP | 02-092426 | 4/1990 |
| JP | 02-131931 | 5/1990 |
| JP | 02-192837 | 7/1990 |
| JP | 03-032835 | 2/1991 |
| JP | 03-275443 | 12/1991 |
| JP | 04-033733 | 2/1992 |
| JP | 04-055028 | 2/1992 |
| JP | 05-32255 | 2/1993 |
| JP | 05-112357 | 5/1993 |
| JP | 05-185170 | 7/1993 |
| JP | 06-127547 | 5/1994 |
| JP | 06-179445 | 6/1994 |
| JP | 07-171645 | 7/1995 |
| JP | 08-168837 | 7/1996 |
| JP | 08-192840 | 7/1996 |
| JP | 2000-109068 | 4/2000 |
| WO | WO 83/02577 | 8/1983 |
| WO | WO 89/10216 | 11/1989 |
| WO | WO 93/17864 | 9/1993 |
| WO | WO 96/37414 | 11/1996 |
| WO | WO 98/34743 | 8/1998 |
| WO | WO 00/12243 | 3/2000 |
| WO | WO 00/64609 | 11/2000 |
| WO | WO 01/41948 | 6/2001 |
| WO | WO 02/43895 | 6/2002 |
| WO | WO 02/068281 | 9/2002 |
| WO | WO 03/059764 | 7/2003 |

(56) References Cited

FOREIGN PATENT DOCUMENTS

| | | |
|---|---|---|
| WO | WO 2005/032953 | 4/2005 |
| WO | WO 2007/005564 | 1/2007 |
| WO | WO 2011/053776 | 5/2011 |

OTHER PUBLICATIONS

Written Opinion for International Patent Application No. PCT/US2011/061113, mailed Mar. 16, 2012 5 pages.

"Brewing Industry Recommended Can Specifications Manual," United States Brewers Assoc., Inc, May 1983, pp. 1-7.

"Beverage Can, End, & Double Seam Dimensional Specifications," Society of Soft Drink Technologists, Aug. 1993, pp. 1-6.

"Guideline Booklet of the Society of Soft Drink Technologists," Can and End Committee of the Society of Soft Drink Technologists, Jun. 5, 1986, pp. 1-21.

International Preliminary Report on Patentability for International Patent Application No. PCT/US2011/061113, mailed May 30, 2013 7 pages.

* cited by examiner

METALLIC BEVERAGE CAN END CLOSURE WITH OFFSET COUNTERSINK

FIELD OF THE INVENTION

Embodiments of the present invention generally relate to containers and container end closures, and more specifically metallic beverage container end closures adapted for interconnection to a neck of a beverage container body.

BACKGROUND OF THE INVENTION

Containers, and more specifically metallic beverage containers, generally contain a neck or an upper portion that is adapted for interconnection to a metallic end closure. The container end closure is formed from a flat sheet of metallic material and generally includes a pull tab or other form of stay on tab (SOT). Beverage containers commonly store carbonated beverages, thus, both the container body and the container end closure are required to sustain internal pressures up to 90 psi without catastrophic failure or permanent deformation. Further, depending on the various conditions that the sealed container is exposed to heat, over fill, high CO2 content, vibration, etc., the internal pressure in a typical beverage container may at times exceed 90 psi. Thus, the container and end closure must be designed to resist deformation and failure while utilizing thin metallic materials.

Beverage containers are manufactured of thin and durable materials, such as aluminum, to decrease the overall cost of the manufacturing process and the weight of the finished product. It is also desirable to reduce the volume of material needed to fabricate the container end closure by optimizing the geometry and to more effectively improve buckle resistance and deformation. Accordingly, there exists a significant need for a durable beverage container end closure that can withstand high internal pressures associated with stored carbonated beverages and external forces applied during shipping, yet which is manufactured with durable, lightweight, reduced gage metallic materials with geometric configurations that reduce material requirements.

In an attempt to decrease material costs and improve strength, end closure engineers position the central panel proximate to the upper portion of the peripheral curl, which can result in other performance issues. More specifically, container end closures with a raised central panel height may experience problems associated with "tab-over-chime." "Tab-over-chime" refers to a geometry where the pull tab is located above the height of the container, which creates stacking problems and thus potential damage during shipping and increased expenses. Thus, it is a challenge to design a container end closure that has improved geometry so that reduced gauge aluminum materials may be used while maintaining buckling and deformation performance of the end closure.

Previous attempts have been made to manufacture container end closures with unique geometric configuration in an attempt to provide material savings and improve strength. One example of a prior art beverage can end may be found in U.S. Pat. No. 7,100,789 to Nguyen et al., which is incorporated by reference in its entirety. Nguyen discloses a beverage container end closure that utilizes less material and has a chuck wall with improved buckle strength attributed to an inwardly oriented concave arch with a radius of curvature between about 0.015 inches and 0.080 inches. Container end closures that employ other unique geometries are disclosed in U.S. Pat. Nos. 7,506,779; 5,685,189; 6,460,723; 6,968,724 and U.S. Patent Application Publication Nos. 2002/015807 and 2005/0029269, which are each incorporated herein by reference.

The following disclosure describes an improved container end closure that is adapted for interconnection to a container body and that employs countersink and chuck wall geometry that decreases material costs while maintaining or improving performance.

SUMMARY OF THE INVENTION

It is thus one aspect of various embodiments of the present invention to provide a metallic container end closure with a novel geometry that can withstand significant internal pressures at times exceeding 90 psi, yet saves material costs. Although the end closures described herein generally apply to beverage containers for carbonated beverages, it should be appreciated by one skilled in the art that various aspects of the invention may be used for any type of container. In one embodiment of the present invention, these attributes are achieved by providing a countersink with an inner panel wall and an outer panel wall that are not parallel or slightly offset to a normal axis that passes through a horizontal plane of a substantially horizontal central panel. For example, one embodiment has an outer panel wall of the countersink that is interconnected to a lower portion of the chuck wall at an angle of about 21 degrees to define an outwardly disposed wall portion, and an inner panel wall, which is substantially parallel to the outer panel wall.

It is a further aspect of the present invention to provide a container end closure with an inner panel wall oriented outwardly away from the normal axis of the central panel. In one embodiment, the inner panel wall is disposed at an angle between about 20° and 30° from the normal axis of the center panel. In a preferred embodiment, the inner panel wall is disposed at angle between about 24° and 26° from the normal axis. In a more preferred embodiment, the inner panel wall is disposed at angle of approximately 25° from the normal axis.

In another aspect of the present invention, a method for forming a beverage can end closure is provided, wherein the container end closure is provided with a countersink radius of no greater than about 0.015 inches, and which is generally positioned at a depth no greater than about 0.084 inches from the central panel. Furthermore, the method forms a metallic end closure with a container having both inner and outer panel walls that are oriented outwardly from a vertical plane, and which utilizes a "reforming" process that alters the original geometry of the end closure or "shell."

In another aspect of the present invention, a container end closure is provided that is manufactured with conventional manufacturing equipment. Thus, existing and well-known manufacturing equipment and processes can be implemented to produce an improved beverage can container end closure as contemplated herein. In another embodiment standard punches and dies used in container manufacturing industry are utilized. After the end closure is initially formed, a "reforming" process is performed to alter the geometry of the container end closure.

It is another related aspect of the present invention to provide a beverage container end closure that saves material costs by reducing the size of the blank material and/or utilizing thinner materials that have improved aluminum alloy properties. Thus, the integrity and strength of the beverage can end closure is not compromised, material costs are significantly reduced, and/or improved material properties are provided.

It is thus one embodiment of the present invention to provide a container end closure adapted for interconnection to a container body, comprising: a peripheral curl adapted for interconnection to a side wall of the container body; a chuck wall interconnected to said peripheral curl and extending downwardly at an angle of at least about 8 degrees as measured from a vertical plane; an outer panel wall interconnected to the lower portion of the chuck wall, said outer panel wall being angled about 8 degrees relative to the vertical plane in an outward direction away from a central longitudinal axis of the container; a countersink interconnected to a lower portion of said outer panel wall and having a radius of curvature less than about 0.017 inches; an inner panel wall interconnected to said countersink and extending upwardly at an angle of between about 15 degrees and 30 degrees as measured from the vertical plane; a central panel interconnected to an upper end of said inner panel wall and raised above a lowermost portion of said countersink at least about 0.084 inches.

It is yet another aspect of the present invention to provide a container end closure, comprising: a circular end wall adapted for interconnection to a side wall of a container; a chuck wall integrally interconnected to said circular end wall and extending downwardly, said chuck wall also interconnected to an outer panel wall; a countersink interconnected to a lower portion of said chuck wall and a lower portion of an inner panel wall and having a radius of curvature less than about 0.017 inches, said inner panel wall being outwardly angled about 25° relative to a vertical plane; and a central panel interconnected to an upper end of said inner panel wall and raised above a lowermost portion of said countersink no greater than about 0.084 inches.

It is still yet another aspect of the present invention to provide a method of manufacturing a metallic end closure, comprising: providing a preformed metallic end closure comprised of: a peripheral curl and a chuck wall extending downwardly therefrom at an angle of at least about 13 degrees as measured from a vertical plane, a countersink having an inner panel wall and an outer panel wall, and a central panel interconnected to an upper end of said inner panel wall; providing a reforming tool which generally comprises an upper cap and a lower cap that provides pressure to deform said metallic end closure, said countersink being held in place by at least one lower key ring; reforming said preformed metallic end closure by: engaging said central panel with said upper cap; engaging an underside of said central panel with a lower insert, said lower insert engaging with a lower retainer via a plurality of springs; contacting an outer surface of said upper cap with said chuck wall; contacting said countersink with said at least one lower key ring; moving said upper cap adjacent to said lower insert; and bringing an outer surface of said lower retainer in contact with said inner panel wall to deflect the inner panel wall, where said inner panel wall is deflected outwardly with respect to an axis perpendicular to said central panel.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated herein, and constitute a part of the specification, illustrate embodiments of the invention and together with the general description of the invention given above and the detailed description of the drawings given below, serve to explain the principles of these inventions.

Figure 1:
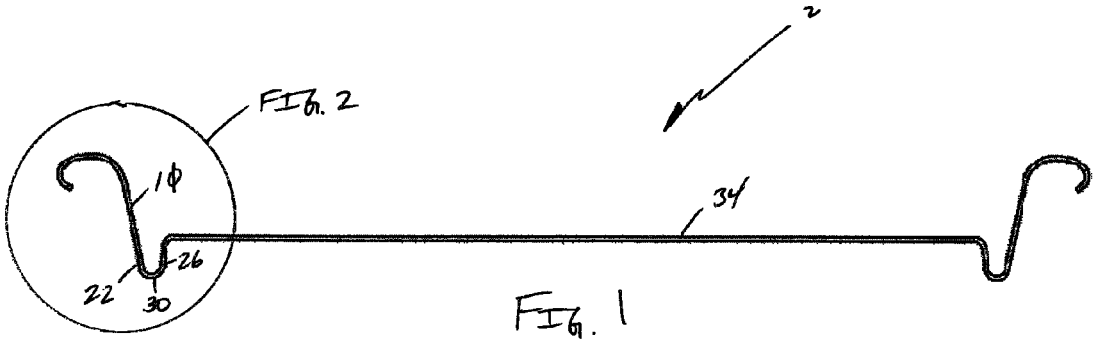
FIG. 1 (PRIOR ART)
FIG. 1 is a cross-sectional view of a prior art container end closure.

To assist in the understanding of one embodiment of the present invention the following list of components and associated numbering found in the drawings is provided herein:

| No. | Components |
|---|---|
| 2 | Container end closure |
| 4 | Container body |
| 6 | Peripheral curl |
| 10 | Chuck wall |
| 14 | Lower end |
| 18 | Upper end |
| 22 | Outer panel wall |
| 26 | Inner panel wall |
| 30 | Countersink |
| 34 | Central panel |
| 38 | Normal axis |
| 42 | Countersink forming tool |
| 46 | Upper cap |
| 50 | Lower cap |
| 54 | Lower key ring |
| 58 | Clamp ring |
| 62 | Upper surface |
| 66 | Underside |

-continued

| No. | Components |
|---|---|
| 70 | Lower insert |
| 74 | Lower retainer |
| 78 | Springs |
| 82 | Outer surface |
| 90 | Angled surface |
| 94 | Inner profile |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
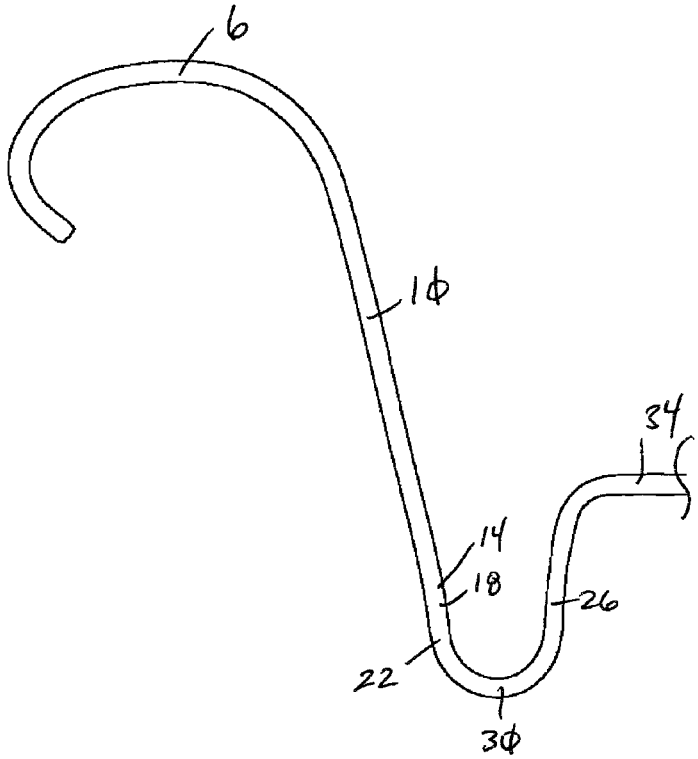
FIG. 2 (PRIOR ART)
FIG. 2 is a detailed view of FIG. 1, showing the countersink portion, chuck, wall and inner and outer wall portion in more detail.

Referring now to FIGS. 1 and 2, a prior art container end closure 2 is shown. Container end closures 2 are typically comprised of a peripheral curl 6 that is adapted for interconnection to an upper edge of a neck of a container body 4 (See FIG. 13) in a double seaming process. The peripheral curl 6 is interconnected to a chuck wall 10 that is angled downward and inwardly toward a central longitudinal axis of the container body. Often, the chuck wall will have more than one angle as disclosed in U.S. Pat. No. 6,460,723. A lower end 14 of the chuck wall 10 is interconnected to an upper end 18 of an outer panel wall 22 that is interconnected to an inner panel wall 26 via a countersink 30. The inner panel wall 26 is also interconnected to a central panel 34 that includes an opening member, for example such as a pull tab or other stay on tab or SOT.

Figure 3:
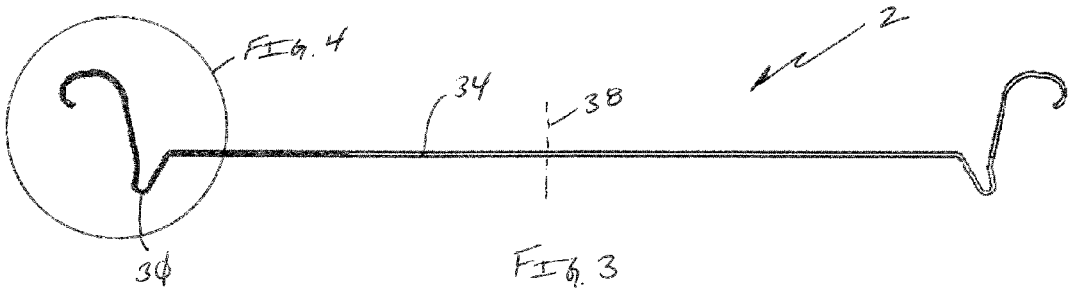
FIG. 3 is a cross-section of a container end closure depicting one embodiment of the present invention.
Figure 4:
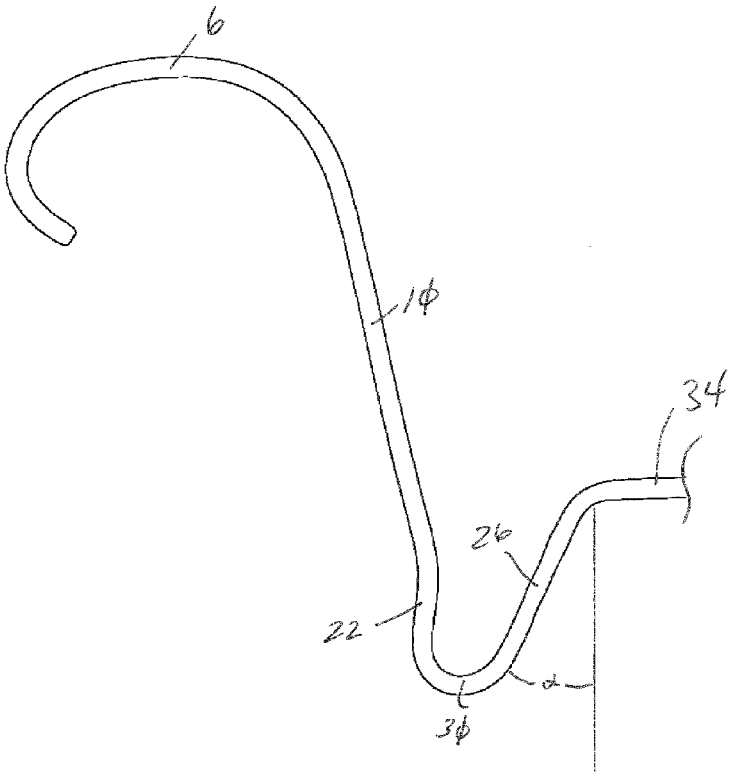
FIG. 4 is a detailed view of the countersink and chuck wall of FIG. 3.
Figure 5:
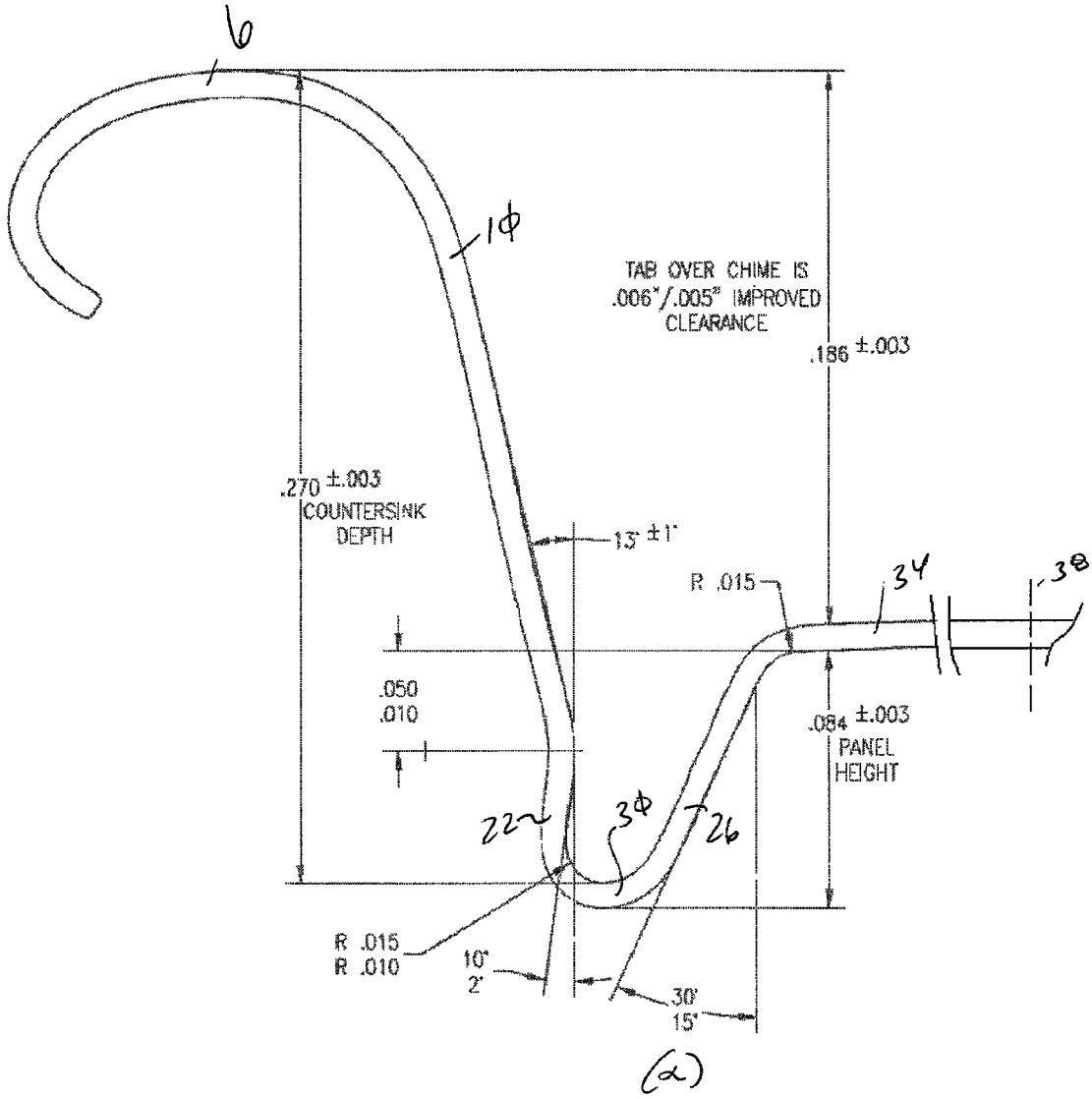
FIG. 5 is a detail of FIG. 3, wherein dimensions associated with one embodiment of the present invention are provided.
Figure 6:
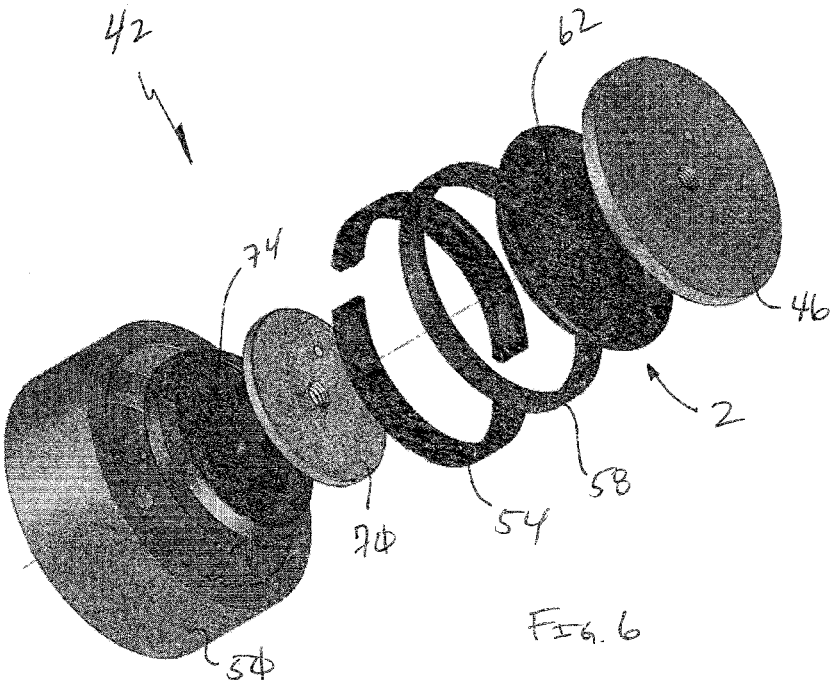
FIG. 6 is an exploded perspective view of a reforming tool used to make one embodiment of the present invention.
Figure 7:
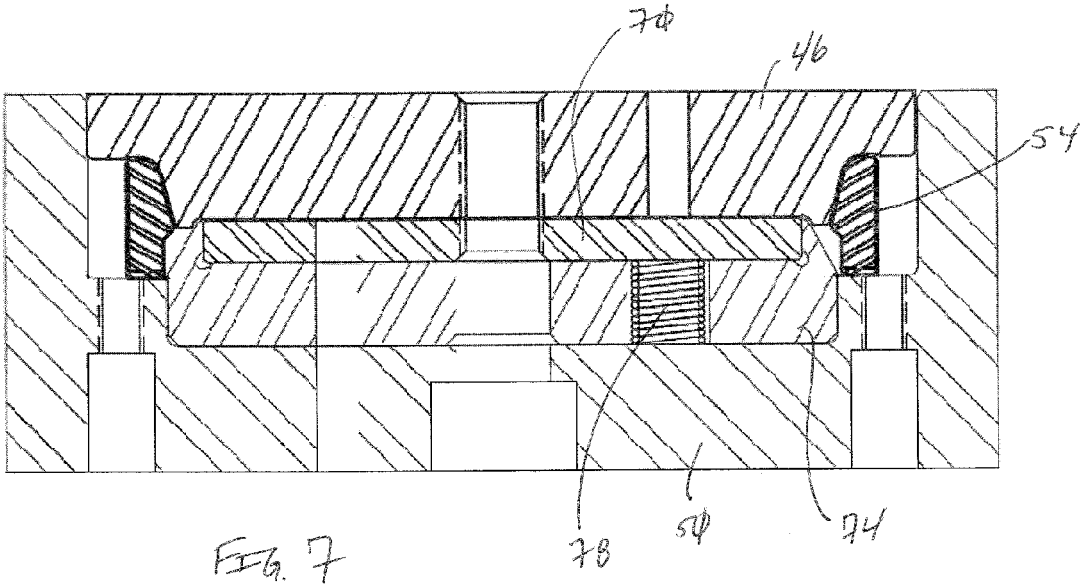
FIG. 7 is a cross-sectional front elevation view of the countersink tool shown in FIG. 6.
Figure 8:
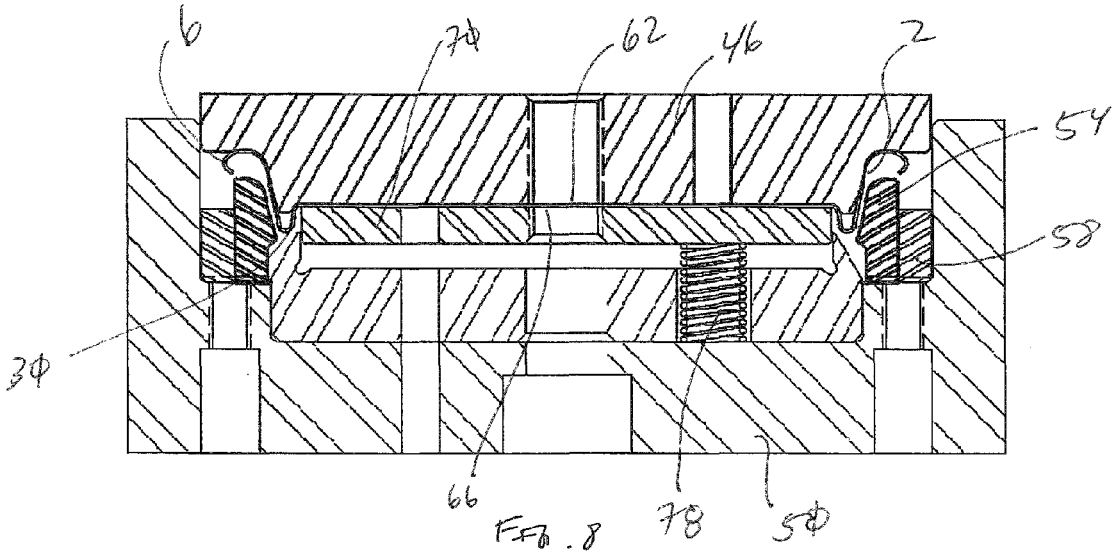
FIG. 8 is a cross-sectional view similar to that of FIG. 7, wherein a container end closure is shown positioned within the tool.
Figure 9:
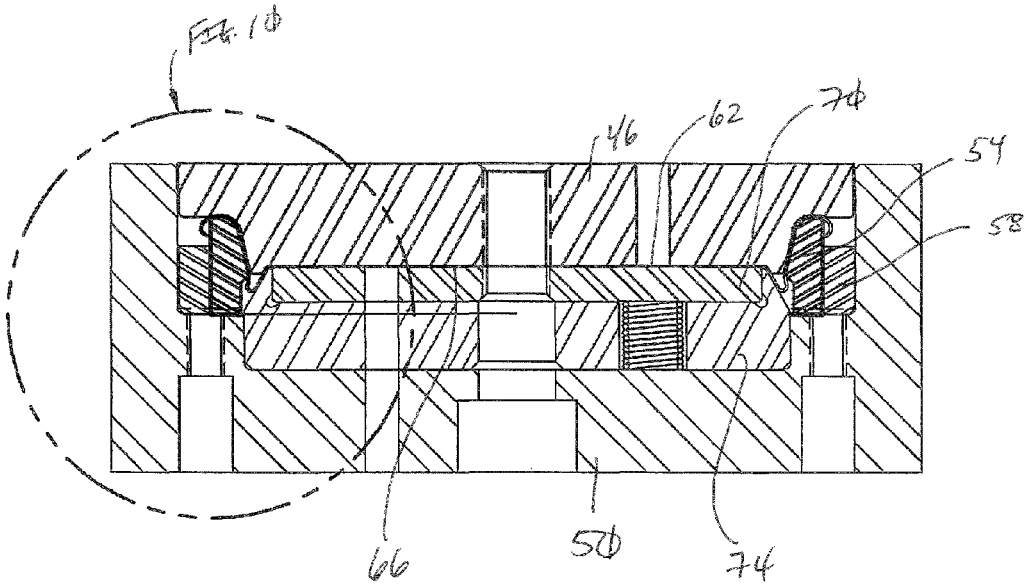
FIG. 9 is a cross-sectional view of the countersinking tool wherein the container end closure has been reformed.
Figure 10:
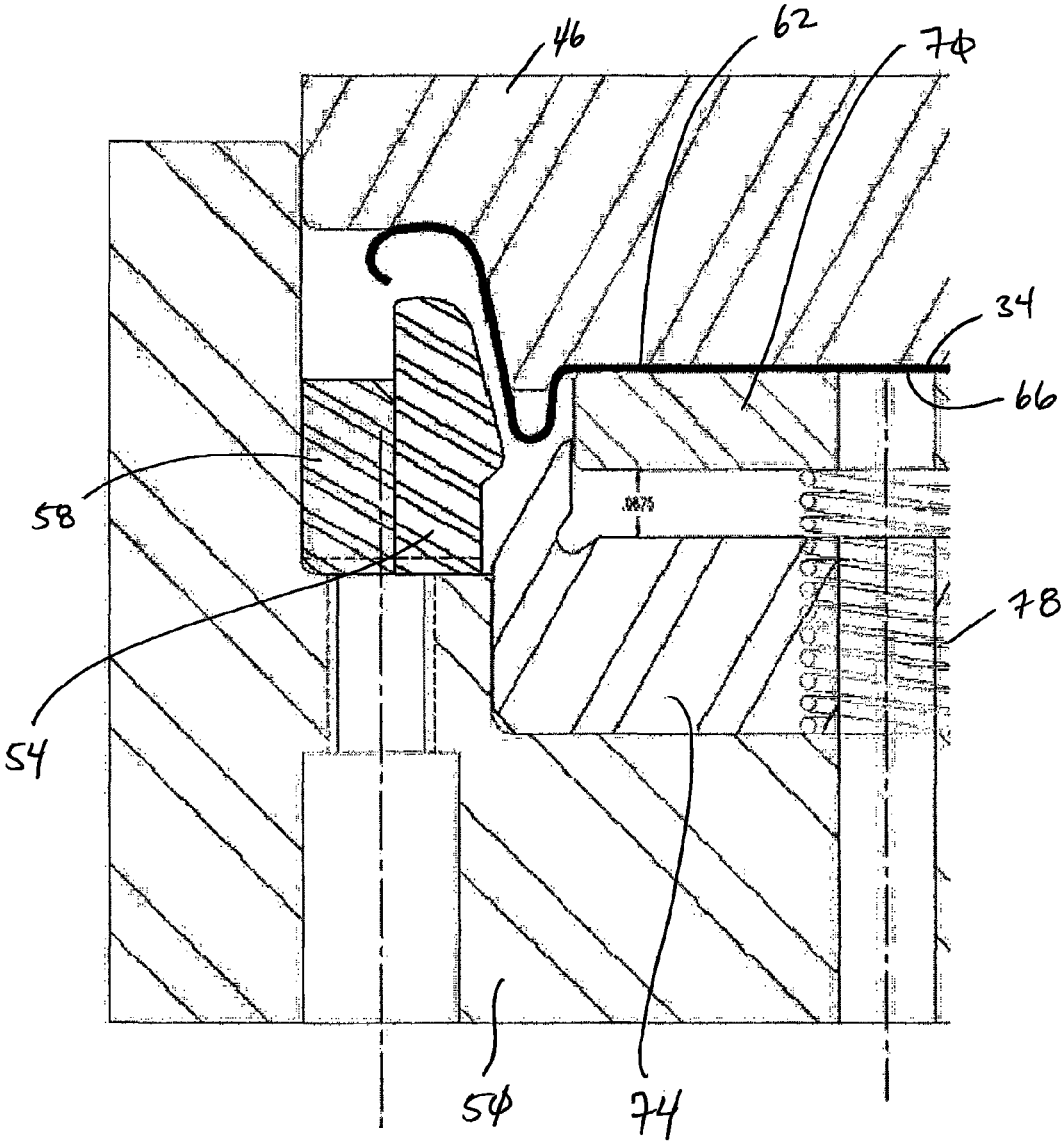
FIG. 10 is a detail view of FIG. 9 showing the container end closure positioned within the reforming tool prior to reforming.

Referring now to FIGS. 3-5, the container end closure 2 of one embodiment of the present invention is shown. Here, a peripheral curl 6 is interconnected to a chuck wall 10 that is interconnected on a lower end to an outer panel wall. Again, it is contemplated that the chuck wall be made of two or any number of separate chuck walls, as disclosed generally in U.S. Pat. No. 6,460,723, and which may include any number of linear, or non-linear arcuate shaped segments. The lower end 64 of the chuck wall 10 is associated with the inner panel wall 26 by the countersink 30. Although the inner panel wall 26 and the outer panel wall 22 are shown to be generally continuous, one skilled in the art will appreciate, however, that the inner panel wall 26 and the outer panel wall 22 may possess dimples or other radii integrated therein as taught by U.S. Pat. No. 7,506,779.

As shown in FIGS. 4 and 5, the outer panel wall 22 in certain embodiments of the present invention is angled outwardly with respect to a normal axis 38 of the central panel (See FIG. 3). The chuck wall 10 is also angled in a different direction with respect to the normal axis 38. Here, the chuck wall 10 is angled inwardly at least about 13 degrees from the normal axis 38 of the central panel 34 and the outer panel wall 22 is angled outwardly from the central panel wall 34 at an angle of at least about 8 degrees. This configuration creates a countersink 30 with an outward orientation. In addition, the inner panel wall 26 is angled ($\alpha$) outwardly in one embodiment of the present invention at least about 25 degrees.

The outward orientation of the countersink as provided herein has the advantage of increasing buckle strength of the container end closure. The table below provides buckle strength test data. Here, "Control Ends" describe prior art or conventional container end closures and are compared to "reformed" container end closures of embodiments of the present invention. On average, buckle strength is increased by about 0.8 psi.

| Test | Control Ends (psi) | Reformed Ends (psi) | Δ (psi) |
|---|---|---|---|
| 1 | 96.6 | 99.0 | 2.4 |
| 2 | 97.7 | 98.4 | 0.7 |
| 3 | 97.1 | 100.4 | 3.3 |
| 4 | 98.6 | 98.9 | 0.3 |
| 5 | 97.3 | 101.0 | 3.7 |
| 6 | 97.3 | 100.0 | 2.7 |
| 7 | 98.2 | 99.8 | 1.6 |
| 8 | 98.6 | 100.5 | 1.9 |
| 9 | 97.4 | 100.2 | 2.8 |
| 10 | 97.2 | 99.7 | 2.5 |
| 11 | 97.7 | 98.7 | 1 |
| 12 | 96.8 | 99.5 | 2.7 |
| 13 | 97.9 | 98.6 | 0.7 |
| 14 | 98.6 | 95.1 | −3.5 |
| 15 | 97.2 | 96.6 | −0.6 |
| 16 | 97.8 | 96.9 | −0.9 |
| 17 | 97.6 | 98.4 | 0.8 |
| 18 | 96.5 | 96.9 | 0.4 |
| 19 | 97.8 | 99.4 | 1.6 |
| 20 | 97.0 | 96.5 | −0.5 |
| 21 | 98.0 | 97.2 | −0.8 |
| 22 | 97.2 | 97.8 | 0.6 |
| 23 | 99.0 | 97.2 | −1.8 |
| 24 | 96.6 | 100.3 | 3.7 |
| 25 | 98.1 | 96.0 | −2.1 |
| 26 | 96.6 | 97.7 | 1.1 |
| 27 | 96.8 | 99.0 | 2.2 |
| 28 | 98.0 | 97.9 | −0.1 |
| 29 | 97.4 | 97.2 | −0.2 |
| 30 | 98.1 | 96.4 | −1.7 |
| Avg. | 97.6 | 98.4 | 0.8 |
| Dev. | 0.672 | 1.542 | |
| High | 99.0 | 101.0 | |
| Low | 96.5 | 95.1 | |

Referring now to FIGS. 6-12, a countersink reforming tool 42 of one embodiment of the present invention is shown that is comprised of an upper cap 46 and a lower cap 50 that provides pressure to deform the container end 2. The countersink 30 of the container end 2 is held in place by lower key rings 54 that are held in place by a clamp ring 58. The upper surface 62 of the central panel 34 is contacted by the upper cap 46 and the underside 66 of the central panel 34 contacts a lower insert 70. The lower insert 70 interacts with a lower retainer 74 via a plurality of springs 78. The lower retainer 74 abuts the lower cap 50.

During reforming operations, the end closure 2 is placed upon the lower insert 70 and the upper cap 46 is brought in contact with an upper surface 62 of the central panel 34. An outer surface 82 of the upper cap 46 contacts the chuck wall 10 and the outer panel wall 22 of the countersink 30 is contacted by at least one lower key 54, which is held in place by a clamp ring 58. The lower insert 70 rests upon the plurality of springs 78 that are associated with the lower retainer 74. The lower retainer 74 includes an angled surface 90, which will contact an inward facing portion of the inner panel wall 26.

Figure 11:
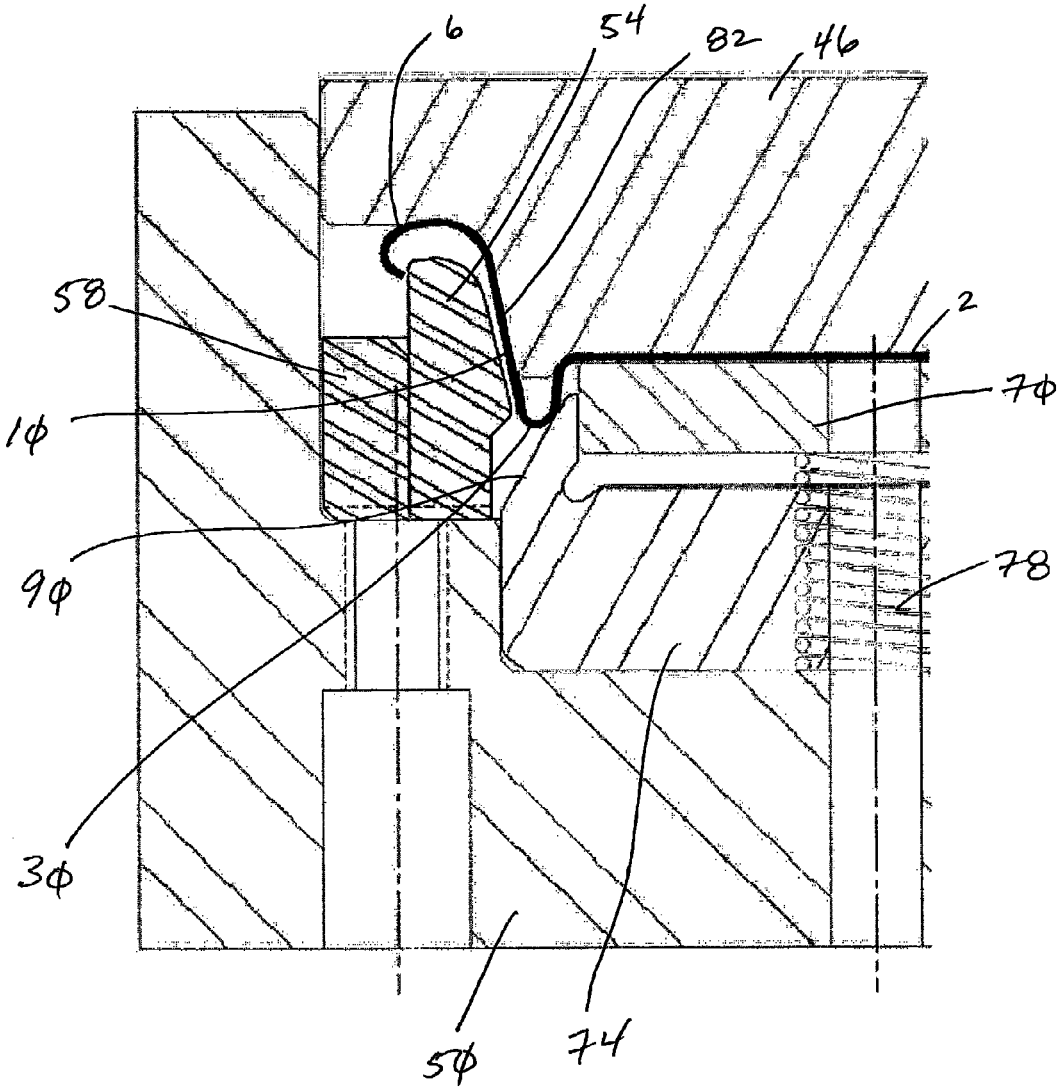
FIG. 11 is a detail view of FIG. 9 showing the container end closure just prior to reforming.
Figure 12:
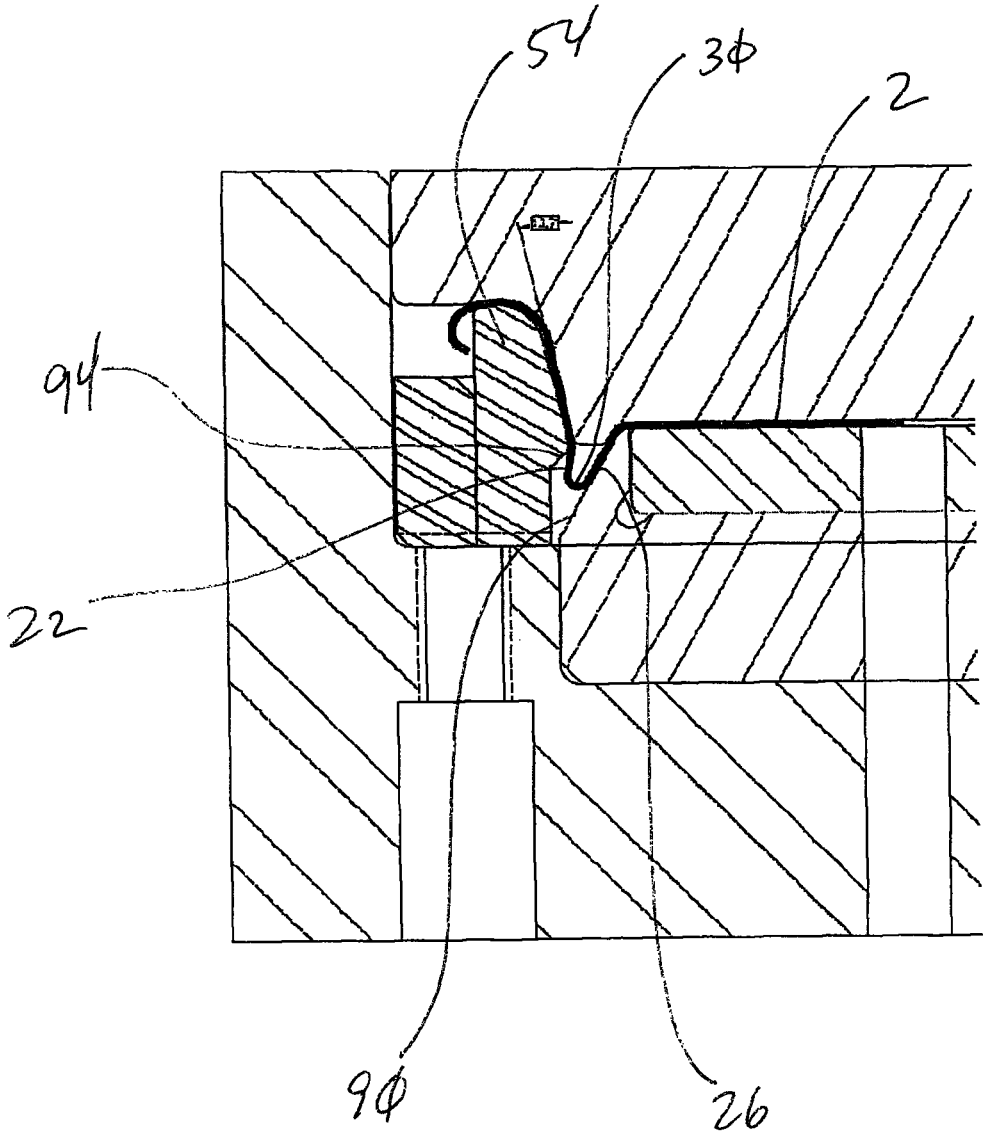
FIG. 12 is a detail view of FIG. 9 showing the container end closure after reforming, and depicting the alteration of the countersink inner and outer panel walls.

During reforming, with particular reference to FIGS. 11 and 12, the upper cap 46 is brought down upon the lower insert 70. As the force acting on the upper cap 46 is increased, the lower insert 70 along with the container end closure 2 is brought to bear onto the outer surface 82 of the lower retainer 74. This abutting relationship deflects the inner panel wall 26 outwardly as shown. The upper cap 46 will also help maintain 1) the radius between the central panel 34 and the inner panel wall 26 (about 0.015 inches in FIG. 5); 2) the angle of the outer panel wall 22 (about 13° in FIG. 5); and 3) the curl height (about 0.186 inches in FIG. 5). Furthermore, the lower key ring 54 includes an inner profile 94 that creates the distinct transition between the countersink and the outer panel wall as shown. As the inner panel wall 26 and associated countersink 30 is forced outwardly, the outer panel wall 22 is brought to bear against the profile 94 of the lower key ring 54 to create the outwardly deflected outer panel wall 22. Deflecting the countersink 30 outwardly also reduces the countersink radius. In one embodiment the countersink radius is reduced from 0.015 inches to about 0.010 inches.

The lower key ring 54 defines a pivot point that deflects the countersink outwardly. In one trial the pivot point was set about 0.0216 inches below the central panel 34 and a 0.0500 inch improvement to "tab to chime" distance was achieved. Again, as used herein "tab to chime" refers to the distance from the central panel to the top of the peripheral curl. This pivot point position also increased the buckle strength of the container end closure by about 0.8 psi.

Figure 13:
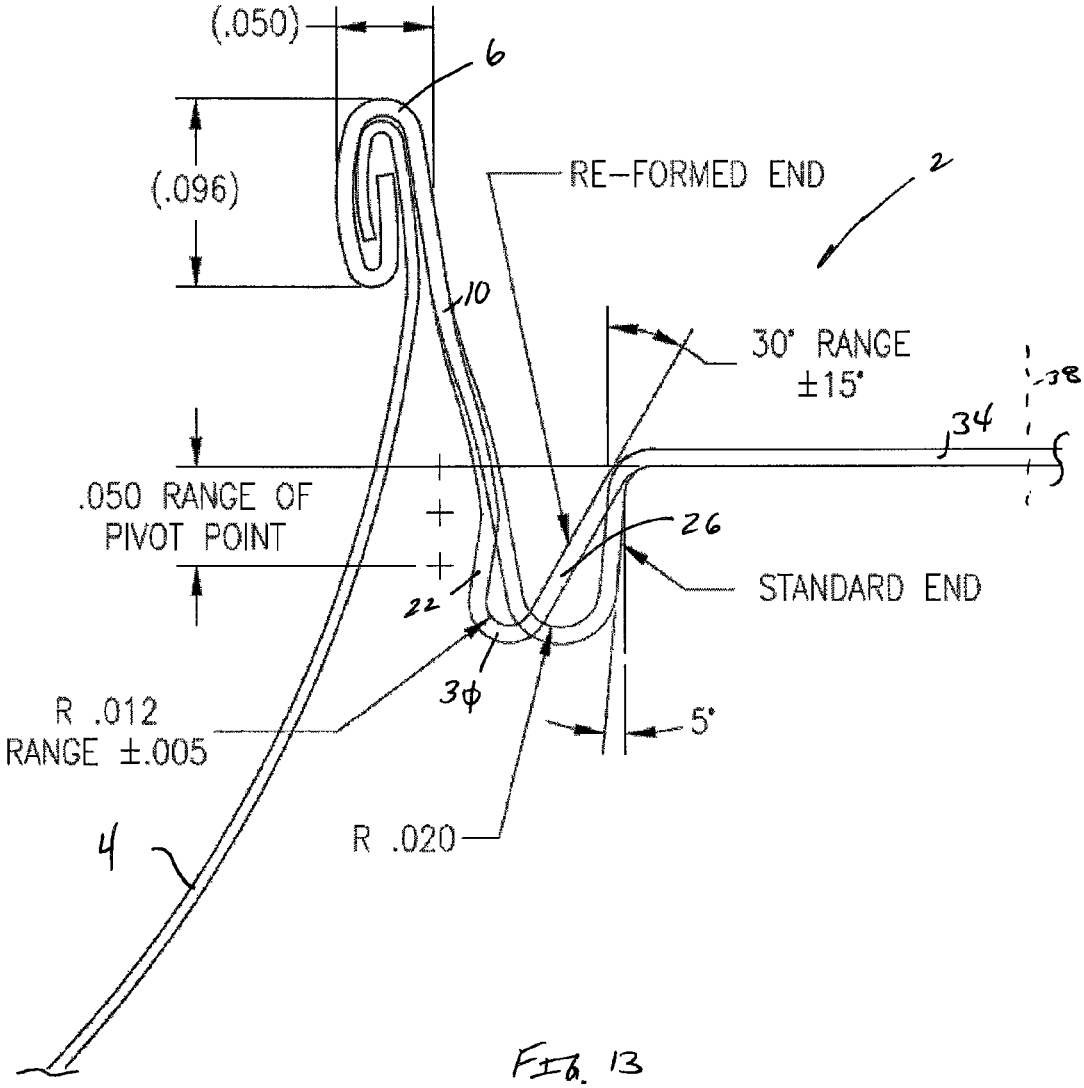
FIG. 13 is a cross sectional front elevation view of the container end closure of one embodiment of the present invention interconnected to a neck of a container body.

FIG. 13 is a cross-sectional view showing the container end closure 2 interconnected to the container body 4 after a double seaming operation has been conducted to interconnect the end closure with the neck of the container. For comparison, the outline of a standard container end closure is shown as well. The container end closure 2 of the present invention is shown with an inner panel wall of the countersink angled at least about 30 degrees outwardly from the normal axis of the central panel 38, which is clearly distinct from the about 5 degree angulation of the inner panel wall of the prior art.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A container end closure adapted for interconnection to a container body, comprising:

a peripheral curl adapted for interconnection to a side wall of the container body;

a chuck wall interconnected to said peripheral curl and extending downwardly and inwardly at an angle of at least about 8 degrees as measured from a vertical plane extending through a longitudinal axis of the container;

an outer panel wall comprising an upper portion interconnected to a lower portion of said chuck wall, a lower portion, and a substantially linear middle portion, wherein said outer panel wall is angled outwardly at least 3 degrees with respect to said vertical plane, and wherein said outer panel wall is not parallel to said vertical plane;

a countersink interconnected to a lower portion of said outer panel wall and having a radius of curvature less than about 0.017 inches;

an inner panel wall interconnected to said countersink and extending upwardly at an angle of between about 15 degrees and 30 degrees as measured from the vertical plane and oriented outwardly in generally the same direction as said outer panel wall, and wherein a distance between said inner panel wall and said outer panel wall on an upper end is no less than a distance between said inner panel wall and said outer panel wall on a lowermost end; and a central panel interconnected to an upper end of said inner panel wall and raised above a lowermost portion of said countersink at least about 0.075 inches.

2. The container end closure of claim 1, wherein said central panel has a depth of at least about 0.175 inches from an uppermost portion of said peripheral curl prior to double seaming.

3. The container end closure of claim 1, wherein a lowermost portion of said chuck wall is substantially linear.

4. The container end closure of claim 1, wherein said end closure is constructed of a metallic material having a thickness no greater than about 0.0090 inches.

5. The container end closure of claim 1, wherein the interconnection of said central panel and said inner panel wall has a radius of curvature no greater than about 0.015 inches.

6. The container end closure of claim 1, wherein said central panel diameter is less than about 75% of a diameter of said circular end wall.

7. The container end closure of claim 1, wherein said end closure is comprised of an aluminum alloy.

8. The container end closure of claim 1, wherein said inner panel wall is substantially linear.

9. A container end closure adapted for interconnection to a neck of a container, comprising:

a circular end wall adapted for interconnection to the neck of the container;

a chuck wall integrally interconnected to said circular end wall and extending downwardly and inwardly from a central axis of the container;

an outer panel wall comprising an upper portion, a lower portion, and a substantially linear middle portion, said upper portion interconnected to a lower end of said chuck wall, said outer panel wall oriented outwardly with respect to a longitudinal axis of the container at an angle of at least about 10 degrees;

a countersink interconnected to a lower portion of said outer panel wall and having a radius of curvature less than about 0.017 inches;

an inner panel wall interconnected to said countersink, said inner panel wall being angled outwardly at least about 15 degrees relative to the longitudinal axis of the container, and wherein a distance between said inner panel wall and said outer panel wall on an upper end is no less than a distance between said inner panel wall and said outer panel wall on a lowermost end; and a central panel interconnected to an upper end of said inner panel wall and raised above a lowermost portion of said countersink no greater than about 0.100 inches.

10. The container end closure of claim 9, wherein said central panel has a diameter less than about 75 percent of the diameter of said circular end wall.

11. The container end closure of claim 9, wherein said central panel has a depth of at least about 0.175 inches from an uppermost portion of said circular end wall.

12. The container end closure of claim 9, wherein said end closure is constructed of a metallic material having a thickness no greater than about 0.0090 inches.

13. The container end closure of claim 9, wherein the interconnection of said central panel and said inner panel wall has a radius of curvature no greater than about 0.015 inches.

14. The container end closure of claim 1, wherein said inner panel wall is angled outwardly about 25 degrees with respect to said vertical plane.

15. The container end closure of claim 1, wherein said countersink has an outward orientation with respect to said vertical plane.

16. The container end closure of claim 1, wherein said outer panel wall is substantially parallel to said inner panel wall.

17. The container end closure of claim 9, wherein said inner panel wall is substantially linear.

18. The container end closure of claim 9, wherein said outer panel wall is substantially parallel to said inner panel wall.

19. The container end closure of claim 9, wherein said countersink has an outward orientation with respect to the longitudinal axis of the container.

* * * * *